United States Patent [19]

Wheatcroft et al.

[11] 4,366,234

[45] Dec. 28, 1982

[54] PROCESS FOR PREPARING PHOTOGRAPHIC SOLUTIONS CONTAINING HYDROQUINONE MONOSULPHONATE

[75] Inventors: John B. Wheatcroft; Edward N. Wall, both of Chesterfield, England

[73] Assignee: Staveley Chemicals Limited, Chesterfield, England

[21] Appl. No.: 268,476

[22] Filed: May 29, 1981

[30] Foreign Application Priority Data

Jun. 5, 1980 [GB] United Kingdom ..... 8018524

[51] Int. Cl.[3] ..... G03C 5/30

[52] U.S. Cl. ..... 430/485; 430/399; 430/441; 260/512 R

[58] Field of Search ..... 260/512 R; 430/441, 430/418, 434, 943, 485, 399, 398, 400

[56] References Cited

U.S. PATENT DOCUMENTS

| | | | |
|---|---|---|---|
| 3,580,956 | 5/1971 | Bloch | 260/512 R |
| 4,046,571 | 9/1977 | Mertz | 430/399 |

FOREIGN PATENT DOCUMENTS

| | | | |
|---|---|---|---|
| 141924 | 5/1980 | Fed. Rep. of Germany | 260/512 R |
| 811519 | 8/1959 | United Kingdom . | |
| 1124390 | 8/1968 | United Kingdom | 260/512 R |
| 1241105 | 7/1971 | United Kingdom . | |

OTHER PUBLICATIONS

L. F. A. Mason, Photographic Processing Chemistry, Focal Press 1966, pp. 35 and 74.

Kirk-Othmer, vol. 15, pp. 371-374.

J. Amer. Chem. Society, James et al., "Oxidation Processes XIII, The Inhibitory Action of Sulfite and Other Compounds in the Autoxidation of Hydroquinone and Its Homologs", vol. 61, pp. 442-450, 1939.

Mason, Photographic Chemistry, 1966, pp. 29-44.

*Primary Examiner*—Mary F. Downey

*Attorney, Agent, or Firm*—Watson, Cole, Grindle & Watson

[57] ABSTRACT

Photographic solutions containing hydroquinone monosulphonate are prepared by a process comprising forming hydroquinone monosulphonate by reacting in solution hydroquinone, a salt of sulphurous acid and hydrogen peroxide. The reaction may be effected in the presence of one or more chemicals required for a photographic developer or after the formation of hydroquinone monosulphonate such material may be added. The invention is useful for making sodium or potassium hydroquinone monosulphonate and may be used in the preparation of a first developer for processing color reversal film, such as by the Kodak E6 process.

8 Claims, No Drawings

PROCESS FOR PREPARING PHOTOGRAPHIC SOLUTIONS CONTAINING HYDROQUINONE MONOSULPHONATE

FIELD OF THE INVENTION

The invention relates to photographic solutions containing hydroquinone momosulphonate and their preparation.

BACKGROUND OF THE INVENTION

Hydroquinone sulphonates are used in some types of photographic developer solutions. Hydroquinone monosulphonate salts are generally produced industrially by processes such as fusing benzoquinone with potassium sulphate which yield a product containing considerable quantities of impurities and which is considerably more expensive than hydroquinone itself.

Hydroquinone monosulphonate is known to be produced when a photographic developer containing hydroquinone, a salt of sulphurous acid and a developing agent such as Metol (4-methylaminophenol) is used to develop an exposed photographic film. Hydroquinone monosulphonate may replace hydroquinone in certain specialized developing solutions. In these developing solutions, a number of advantages may be gained by using hydroquinone monosulphonate, particularly when it is used in the first or black or white developer of a reversal process for the production of a colour slide. Hydroquinone monosulphonate may be used in the E6 process developed by the Kodak company and this E6 process has now been adopted by major film manufacturers including Kodak, Fuji Photofilm Company Limited and the 3M Company. The wider use of hydroquinone monosulphonate in developer solutions is hampered by its present excessive cost.

Both potassium and sodium hydroquinone monosulphonate are expensive to use, not only because of their basic cost but because a larger weight of the chemical has to be used than would be required if hydroquinone was present in the developer rather than the hydroquinone monosulphonate. Also potassium or sodium hydroquinone monosulphates are not readily available, so manufacturers of kits and suppliers of solutions to the commercial film developing companies tend to use less satisfactory alternatives.

Recovery of sodium or potassium hydroquinone monosulphonate from solution is difficult and expensive, primarily as a result of its high solubility, so purification of the normal commercial product is difficult when a solid product is desired.

SUMMARY OF THE INVENTION

According to the present invention a process is provided for making a photographic solution containing hydroquinone monosulphonate, which process comprises forming hydroquinone monosulphonate by reacting in solution hydroquinone, a salt of sulphurous acid and hydrogen peroxide.

DESCRIPTION OF PREFERRED EMBODIMENTS

The reaction may be affected in the presence of some or all of other active ingredients of the desired photographic solution.

Preferably, however, the monosulphonate-forming reaction is carried out first and the remaining ingredients for the desired solution are then added.

Further materials which may be added after the formation of hydroquinone monosulphonate may be any of the chemicals normally used in developers, for example, potassium bromide, potassium thiocyanate, potassium iodide, diethylene glycol, phenidone, potassium carbonate or sodium bicarbonate.

Preferably the salt of sulphurous acid is sodium or potassium sulphite or a mixture thereof. It is generally preferred that the formation of hydroquinone monosulphonate is effected in the presence of a further amount of sulphite over that required to form the hydroquinone monosulphonate.

Preferably the reaction is carried out by mixing hydroquinone, a salt of sulphurous acid and hydrogen peroxide together in solution. It is possible to react the hydroquinone and hydrogen peroxide in the absence of sulphite and then add the sulphite to produce the monosulphonate desired, but discoloured product results.

It will be understood by those skilled in the art that further chemicals added to the solution of hydroquinone monosulphonate produced by the reaction described above may be those necessary to make a photographic developer, for example, a modified Kodak E6 developer in which hydroquinone monosulphonate replaces the normal hydroquinone. Conveniently, the photographic developer may be produced by making a first solution in which the hydroquinone monosulphonate is formed, with the remaining chemicals for the photographic developer being dissolved in water to form a second solution, with the formation of the desired developer by mixing the two solutions. It is convenient to use in solutions a chelating agent, such as a sodium salt of ethylenediaminetetraacetic acid.

The photographic solution produced according to the invention may be a concentrate diluteable to produce a developer solution.

In the photographic art it is well-known to produce a developer which is capable of developing films as required, but thereafter depletion of certain chemicals takes place so that the developer is no longer usable. Furthermore, some of the volume of the developer solution is lost. Frequently the developing action of such solutions is restored by the addition of a replenisher. In one aspect of the present invention, therefore, the photographic solution resulting from the process of this invention is a replenisher for a photographic developer.

The invention includes a colour processing kit comprising a photographic solution produced by the process of the invention and other colour processing materials, such as bleach and fixer. The kit may for example be an E6 developing kit for colour reversal film.

Following is a description by way of example of processes in accordance with this invention.

EXAMPLE 1

A first solution was made by dissolving in 150 mls. water, 12.5 g. of sodium sulphite and 5.5 g. of hydroquinone; the pH of the resulting solution was raised to about pH9 and 5 mls. of 40 volumes hydrogen peroxide was then added and the formation of sodium hydroquinone monosulphonate occurred rapidly.

A second solution was prepared by dissolving in 150 mls. of water the following ingredients:

sodium ethylenediaminetetraacetic acid 0.25 grms.

potassium bromide 10% solution 18.0 mls.
potassium thiocyanate 20% solution 2.5 mls.
potassium iodide 0.1% solution 1.7 mls.
diethylene glycol 6.0 mls.
phenidone 0.7 grms.
potassium carbonate 7.0 g.
sodium bicarbonate 6.0 g.

The modified Kodak E6 developer was then formed by mixing the first and second solutions and adding a further quantity of water to make the volume 500.0 mls. The pH of this solution was found to be 9.6±0.05.

The developer was used as the first developer in the development of a colour reversal film and was found to give very satisfactory results which were at least equal to those achieved using a developer made up using commercially available potassium hydroquinone monosulphonate. It may well be that some benefit is obtained using the invention because one can obtain hydroquinone in a pure form and the amount of hydroquinone monosulphonate produced can be precisely determined as the reaction which occurs is quantitative.

In a modification of the process described in the above example, half the sodium ethylenediaminetetraacetic acid may be used in the first solution and half in the second solution. In the further modification, the first solution may be made up using 11.0 grms. of sodium sulphite rather than the specified 8.0 g. In yet a further modification, the first solution may contain 11.0 g. of sodium sulphite and the potassium bromide required may be added to the first solution and not the second solution, and the amount of potassium bromide solution may, if desired, be reduced to 15.0 mls. Further potassium sulphite may be used in place of the specified sodium sulphite.

It is preferred to maintain the pH of a solution for developing a reversal film within close limits, i.e. at 27° C. the pH should be 9.60±0.05.; if necessary the pH can be adjusted by using a 10% solution of NaOH or a 7 N solution of $H_2SO_4$.

EXAMPLE 2

A replenisher solution suitable for replenishing the developing solution of Example 1 was prepared by first preparing a first solution containing:

Water: 150 mls.
Sodium sulphite: 13.2 grms.
Hydroquinone: 5.8 grms.
Hydrogen Peroxide (40 vols): 5.0 mls.

and adding thereto after the hydroquinone monosulphonate forming reaction a second solution containing:

Water: 150 mls.
Sodium ethylenediaminetetraacetic acid: 0.25 grm.
Potassium bromide 10% solution: 11.5 mls.
Potassium thiocyanate 20% solution: 2.5 mls.
Potassium iodide 0.1% solution: 0.6 mls.
Diethylene glycol: 6.0 mls.
Phenidone: 0.75 grms.
Potassium Carbonate: 7.0 grms.
Sodium bicarbonate: 6.0 grms.

and making up the volume to 500 mls. with water. The pH was adjusted to 9.6 as described above.

It may be observed that this replenisher is generally similar to the original developer solution but contains less bromide because bromide is liberated in the developing process and accumulates in the developer.

We claim:

1. A process for making a photographic solution containing hydroquinone monosulphonate, said process comprising the steps of (a) forming an aqueous solution containing hydroquinone, a salt of sulphurous acid and hydrogen peroxide, and (b) causing the hydroquinone, the salt of sulphurous acid and the hydrogen peroxide in the aqueous solution to react to form hydroquinone monosulphonate.

2. A process as claimed in claim 1 wherein at least one further active ingredient for the photographic solution is present in the aqueous solution during step (b).

3. A process as claimed in claim 1 wherein at least one further active ingredient for the photographic solution is added to the aqueous solution after step (b).

4. A process as claimed in claim 3 wherein the reaction in step (b) provides a first solution containing hydroquinone monosulphonate, wherein the remaining chemicals required for a photographic solution are dissolved in water to form a second solution, and wherein the desired developer is formed by mixing the two solutions.

5. A process as claimed in claim 1 wherein said salt of sulphurous acid is selected from the group consisting of sodium sulphite, potassium sulphites and a mixture thereof.

6. A process as claimed in claim 1 wherein said hydroquinone monosulphonate is formed in the presence of a further amount of sulphite over that required to form the hydroquinone monosulphonate.

7. A process as claimed in claim 1 wherein the resulting photographic solution is a photographic developer solution.

8. A process as claimed in claim 1 wherein the resulting photographic solution is a replenisher for a photographic developer.

* * * * *